US008866457B2

(12) United States Patent
Endo et al.

(10) Patent No.: US 8,866,457 B2
(45) Date of Patent: Oct. 21, 2014

(54) VOLTAGE REGULATOR

(75) Inventors: Daiki Endo, Chiba (JP); Socheat Heng, Chiba (JP)

(73) Assignee: Seiko Instruments Inc., Chiba (JP)

( * ) Notice: Subject to any disclaimer, the term of this patent is extended or adjusted under 35 U.S.C. 154(b) by 289 days.

(21) Appl. No.: 13/564,876

(22) Filed: Aug. 2, 2012

(65) Prior Publication Data

US 2013/0033247 A1 Feb. 7, 2013

(30) Foreign Application Priority Data

Aug. 5, 2011 (JP) ..... 2011-171780

(51) Int. Cl.
*G05F 1/575* (2006.01)

(52) U.S. Cl.
CPC ..... *G05F 1/575* (2013.01)
USPC ..... 323/280; 323/226

(58) Field of Classification Search
CPC ..... G05F 1/461; G05F 1/575
USPC ..... 323/273, 280, 226
See application file for complete search history.

(56) References Cited

U.S. PATENT DOCUMENTS

| | | | | |
|---|---|---|---|---|
| 8,547,079 | B2 * | 10/2013 | Socheat | 323/284 |
| 2006/0091866 | A1 * | 5/2006 | Tokumitsu et al. | 323/280 |
| 2008/0218139 | A1 * | 9/2008 | Takagi | 323/280 |
| 2010/0213909 | A1 * | 8/2010 | Nakashimo | 323/282 |

OTHER PUBLICATIONS

Milliken, Robert J. et al., "Full On-Chip CMOS Low-Dropout Voltage Regulator," *IEEE Transactions on Circuits and Systems-I: Regular Papers*, vol. 54, No. 9, Sep. 2007, pp. 1879-1890.

* cited by examiner

*Primary Examiner* — Harry Behm
*Assistant Examiner* — Matthew Grubb
(74) *Attorney, Agent, or Firm* — Brinks Gilson & Lione

(57) ABSTRACT

A voltage regulator has a phase compensation circuit which changes consumption current according to load current thereby to reduce consumption current. The phase compensation circuit includes: a first transistor having a drain connected to an output terminal of an error amplifier circuit; a second transistor having a drain connected to a gate of the first transistor and a gate connected to the gate of the first transistor; a current mirror circuit connected to the output terminal of the error amplifier circuit, a drain of the first transistor, and the drain of the second transistor; and a capacitor connected between the gate of the second transistor and a drain of an output transistor. Thereby, current consumed by the phase compensation circuit can be changed according to the load current, resulting in that the voltage regulator consumes less current.

5 Claims, 7 Drawing Sheets

VOLTAGE REGULATOR

RELATED APPLICATIONS

This application claims priority under 35 U.S.C. §119 to Japanese Patent Application No. 2011-171780 filed on Aug. 5, 2011, the entire content of which is hereby incorporated by reference.

BACKGROUND OF THE INVENTION

1. Field of the Invention

The present invention relates to a phase compensation circuit of a voltage regulator and reduction in power consumption thereof.

2. Description of the Related Art

As a conventional voltage regulator that stably operates regardless of output capacity or output resistance, the circuit illustrated in FIG. 6 has been known.

The conventional voltage regulator is constituted of a reference voltage circuit 101, a differential amplifier circuit 102, a PMOS transistor 106, a phase compensation circuit 460, resistors 108 and 109, a ground terminal 100, an output terminal 121, and a supply terminal 150. The phase compensation circuit 460 is constituted of a constant current circuit 405, NMOS transistors 401, 406, 403 and 408, a capacitor 407, and a resistor 404. The differential amplifier circuit 102 is constituted of a one-stage amplifier illustrated in FIG. 7.

Regarding the connection, an inverting input terminal of the differential amplifier circuit 102 is connected to the reference voltage circuit 101, a non-inverting input terminal thereof is connected to a connection point of the resistors 108 and 109, and an output terminal thereof is connected to the gate of the PMOS transistor 106 and the drain of the NMOS transistor 401. The other end of the reference voltage circuit 101 is connected to the ground terminal 100. The source of the NMOS transistor 401 is connected to the drain of the NMOS transistor 403, and the gate thereof is connected to the gate and the drain of the NMOS transistor 406. The source of the NMOS transistor 403 is connected to the ground terminal 100, and a gate thereof is connected to the resistor 404 and the drain of the NMOS transistor 408. The source of the NMOS transistor 408 is connected to the ground terminal 100, the gate thereof is connected to the other end of the resistor 404 and the capacitor 407, and the drain thereof is connected to the source of the NMOS transistor 406. The drain of the NMOS transistor 406 is connected to a constant current circuit 405, and the other end of the constant current circuit 405 is connected to the supply terminal 150. The source of the PMOS transistor 106 is connected to the supply terminal 150, and the drain thereof is connected to the output terminal 121, the other end of the capacitor 407, and the other end of the resistor 108. The other end of the resistor 109 is connected to the ground terminal 100 (refer to, for example, non-patent document 1).

PRIOR ART DOCUMENTS

Non-Patent Documents

[Non-Patent Document 1] IEEE TRANSACTIONS ON CIRCUITS AND SYSTEMS-I: REGULAR PAPERS, VOL. 54, NO. 9, SEPTEMBER 2007 (FIG. 13)

However, according to the conventional art, the phase compensation circuit 460 is adapted to pass a part of the current at the output terminal of the differential amplifier circuit 102 to the ground. Hence, current passes to an output terminal from a transistor 503 of the differential amplifier circuit 102, causing imbalance in the current flowing to input transistors 501 and 504 with consequent occurrence of an offset. This has been posing a problem in that it is difficult to obtain an accurate output voltage.

Further, fixed current is constantly supplied for operating the phase compensation circuit 460 regardless of the magnitude of a load current, so that unnecessarily large power has been consumed for a light load.

SUMMARY OF THE INVENTION

Accordingly, an object of the present invention is to solve the problem described above by providing a voltage regulator capable of stably operating independently of output capacity or output resistance to obtain an accurate output voltage and also capable of reducing power consumed in the case of a light load.

To this end, there is provided a voltage regulator including: an error amplifier circuit which amplifies and outputs the difference between a reference voltage and a divided voltage obtained by dividing a voltage output by an output transistor thereby to control the gate of the output transistor; and a phase compensation circuit, wherein the phase compensation circuit includes: a first transistor having a drain thereof connected to an output terminal of the error amplifier circuit; a second transistor having a drain thereof connected to a gate of the first transistor and a gate thereof connected to the gate of the first transistor through a resistor; a current mirror circuit connected to an output terminal of the error amplifier circuit, a drain of the first transistor, and the drain of the second transistor; and a capacitor connected between the gate of the second transistor and a drain of the output transistor.

The voltage regulator equipped with the phase compensation circuit in accordance with the present invention is capable of preventing the occurrence of an offset caused by disturbed balance of current passing through an input transistor of a differential amplifier circuit, thus allowing an accurate output voltage to be obtained, and also capable of operating with stability and high speed independently of output capacity or output resistance. Moreover, the voltage regulator according to the present invention is capable of controlling power consumption to a minimum for a light load.

DETAILED DESCRIPTION OF THE PREFERRED EMBODIMENTS

Embodiments of the present invention will be described with reference to the accompanying drawings.

First Embodiment

Figure 1:
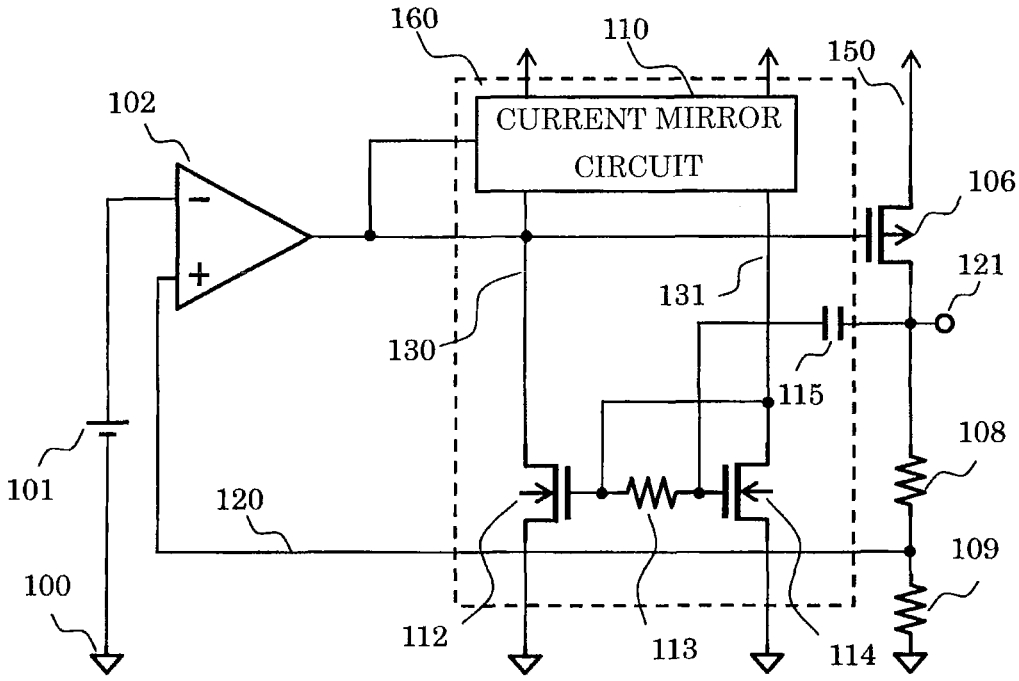
FIG. 1 is a circuit diagram illustrating a first embodiment of a voltage regulator.

First, the configuration of a voltage regulator will be described. FIG. 1 is a circuit diagram illustrating the voltage regulator in accordance with the present invention.

The voltage regulator is constituted of a reference voltage circuit 101, a differential amplifier circuit 102, a phase compensation circuit 160, a PMOS transistor 106, resistors 108 and 109, a ground terminal 100, an output terminal 121, and a supply terminal 150. The phase compensation circuit 160 is constituted of NMOS transistors 112 and 114, a capacitor 115, a resistor 113, and a current mirror circuit 110. The current mirror circuit 110 has four terminals, namely, a terminal 1, a terminal 2, a terminal 3, and a terminal 4, and outputs a predetermined current from the terminal 2 or the terminal 3 on the basis of a voltage supplied to the terminal 1.

The following will describe the connection of an element circuit of the voltage regulator.

The inverting input terminal of the differential amplifier circuit 102 is connected to the reference voltage circuit 101, the non-inverting input terminal thereof is connected to the connection point of the resistors 108 and 109, and the output terminal thereof is connected to the gate of the PMOS transistor 106, the drain of the NMOS transistor 112, and the terminal 1 and the terminal 2 of the current mirror circuit 110. The other end of the reference voltage circuit 101 is connected to the ground terminal 100. The source of the NMOS transistor 112 is connected to the ground terminal 100, and the gate thereof is connected to the resistor 113 and the drain of the NMOS transistor 114. The gate of the NMOS transistor 114 is connected to the other end of the resistor 113 and the capacitor 115, the drain thereof is connected to the terminal 3 of the current mirror circuit 110, and the source thereof is connected to the ground terminal 100. The terminal 4 of the current mirror circuit 110 is connected to the supply terminal 150. The source of the PMOS transistor 106 is connected to the supply terminal 150, the drain thereof is connected to the output terminal 121, the other end of the capacitor 115, and the other end of the resistor 108. The other end of the resistor 109 is connected to the ground terminal 100.

The operation of the voltage regulator will now be described.

As the voltage of the output terminal 121 increases, the voltage of a node 120 increases accordingly. If the voltage of the node 120 becomes higher than the voltage of the reference voltage circuit 101, then the output voltage of the differential amplifier circuit 102 increases. This causes the gate voltage of the PMOS transistor 106 to increase, so that the drain current of the PMOS transistor 106 decreases and the voltage at the output terminal 121 decreases. Thus, the output terminal is controlled to have a constant desired voltage.

In the voltage regulator illustrated in FIG. 1, poles are generated at frequencies indicated by the following expressions.

$$fp1 = \frac{1}{2\pi\{R_1 Gm_{P106} R_{out}(Gm_{N114} R_{113} C_{115})\}} \quad (1)$$

$$fp2 = \frac{Gm_{P106}(Gm_{N114} R_{113} C_{115})}{2\pi C_{out} C_G} \quad (2)$$

where $R_1$ denotes a parasitic resistance component of an output impedance of the differential amplifier circuit 102; $R_{out}$ denotes a load resistance connected to the output terminal 121; $Gm_{P106}$ denotes the transconductance of the PMOS transistor 106; $Gm_{N114}$ denotes the transconductance of the NMOS transistor 114; $R_{113}$ denotes the resistance value of the resistor 113; $C_{115}$ denotes the capacitance value of the capacitor 115; $C_{out}$ denotes the output capacitance to be connected; and $C_G$ denotes the gate capacitance value of the PMOS transistor 106.

As understood from expressions 1 and 2, the positions of the first pole and the second pole can be adjusted by the resistor 113, the capacitor 115, and the transconductance of the NMOS transistor 114, thus permitting adjustment for the stable operation independently of the output resistance Rout and the output capacitance $C_{out}$.

The output terminal of the differential amplifier circuit 102 is connected to the drain of the NMOS transistor 112 and the current mirror circuit 110, so that the current to the NMOS transistor 112 can be supplied from the current mirror circuit 110. Further, no current passes from the output terminal of the differential amplifier circuit 102 to the NMOS transistor 112, so that there will be no offset occurring in a transistor of the input stage of the differential amplifier circuit 102. This arrangement prevents fluctuations in the output voltage attributable to the offset, making it possible to accurately set an output voltage.

Based on the expressions given above, if the load resistance $R_{out}$ is sufficiently high, then the positions of the first pole and the second pole can be separated even when $Gm_{N114}$ is small. In this case, Gm of a MOS transistor is denoted by the following expression.

$$Gm=(2I_{DS}\mu C_{OX}W/L)^{1/2} \quad (3)$$

Based on the above expression, if the load resistance $R_{out}$ is sufficiently high, then the stable operation can be achieved even when the drain current of the NMOS transistor 114 of the phase compensation circuit 160 is reduced.

Thus, the drive current can be controlled to remain low by limiting the value of current to be supplied to the phase compensation circuit 160 from the current mirror circuit 110 according to the magnitude of the current passing from the PMOS transistor 106 to the load resistance $R_{out}$.

As described above, the voltage regulator in accordance with the present invention is capable of preventing the occurrence of an offset in the transistor of the input stage of the differential amplifier circuit 102 so as to prevent fluctuations in the output voltage attributable to the offset, thus permitting accurate setting of an output voltage. In addition, the consumption current of the phase compensation circuit 160 can be controlled to be low according to the magnitude of the current passed from the PMOS transistor 106 to the load resistance $R_{out}$.

Second Embodiment

Figure 2:
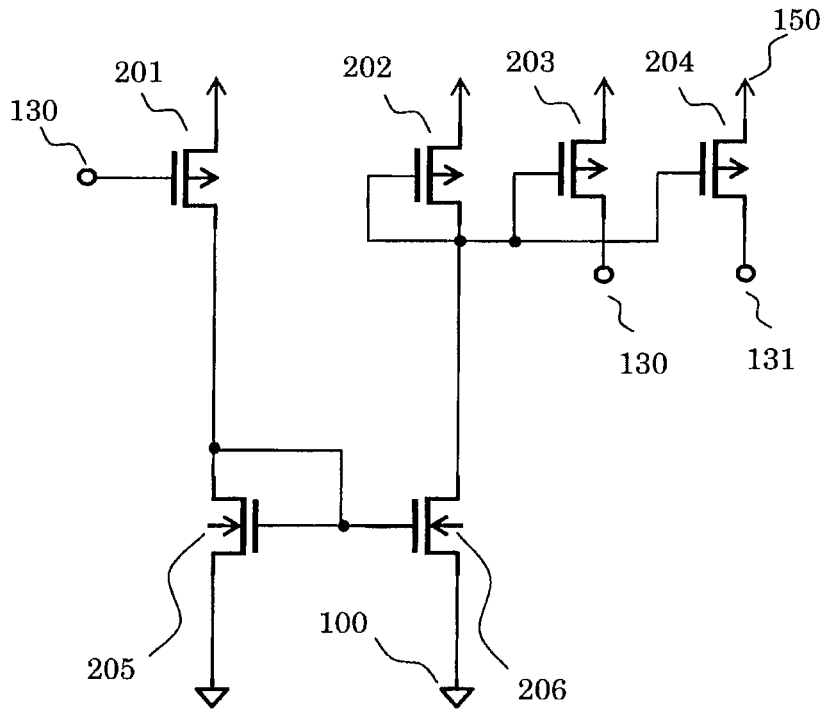
FIG. 2 is a circuit diagram illustrating a first embodiment of a current mirror circuit.

FIG. 2 is a circuit diagram illustrating a first embodiment of a current mirror circuit 110 related to the voltage regulator in accordance with the present invention. The current mirror circuit 110 is constituted of PMOS transistors 201, 202, 203, 204, and NMOS transistors 205 and 206. The source of the PMOS transistor 201 is connected to a supply terminal 150, the gate thereof is connected to a node 130, which is the output of a differential amplifier circuit 102, and the drain thereof is connected to the drain of the NMOS transistor 205. The source of the NMOS transistor 205 is connected to a ground terminal 100, and the gate thereof is connected to the drain of the NMOS transistor 205 and the gate of the NMOS transistor 206. The source of the NMOS transistor 206 is connected to the ground terminal 100, and the drain thereof is connected to the drain of the PMOS transistor 202. The source of the PMOS transistor 202 is connected to the supply terminal 150 and the gate thereof is connected to the drain of the PMOS transistor 202 and the gates of the PMOS transistor 203 and the PMOS transistor 204. The source of the PMOS transistor 203 is connected to the supply terminal 150, and the drain thereof is connected to the drain of the NMOS transistor 112 of the phase compensation circuit 160. The source of the PMOS transistor 204 is connected to the supply terminal 150, and the drain thereof is connected to the drain of an NMOS transistor 114 of the phase compensation circuit 160.

In the current mirror circuit according to the first embodiment, the gate voltage of the PMOS transistor 106, which is the output of the differential amplifier circuit 102, is input to the gate of the PMOS transistor 201. The drain current of the PMOS transistor 201 changes according to the value of current passed from the PMOS transistor 106 to the load resistor. The drain current of the PMOS transistor 201 is mirrored on the PMOS transistor 202 by the current mirror formed of the NMOS transistors 205 and 206, and a mirror current, which is based on the value of the current supplied from the PMOS transistor 106 to the load resistance, is passed to the phase compensation circuit 160 by the current mirror formed of the PMOS transistors 202, 203 and 204.

As described above, the voltage regulator in accordance with the present invention, which has the phase compensation circuit with the current mirror circuit of the first embodiment, is capable of preventing the occurrence of an offset in the transistor of the input stage of the differential amplifier circuit 102 so as to prevent fluctuations in the output voltage attributable to the offset, thus permitting accurate setting of an output voltage. In addition, the consumption current of the phase compensation circuit 160 can be controlled to a low level according to the magnitude of the current passed from the PMOS transistor 106 to the load resistance $R_{out}$.

Third Embodiment

Figure 3:
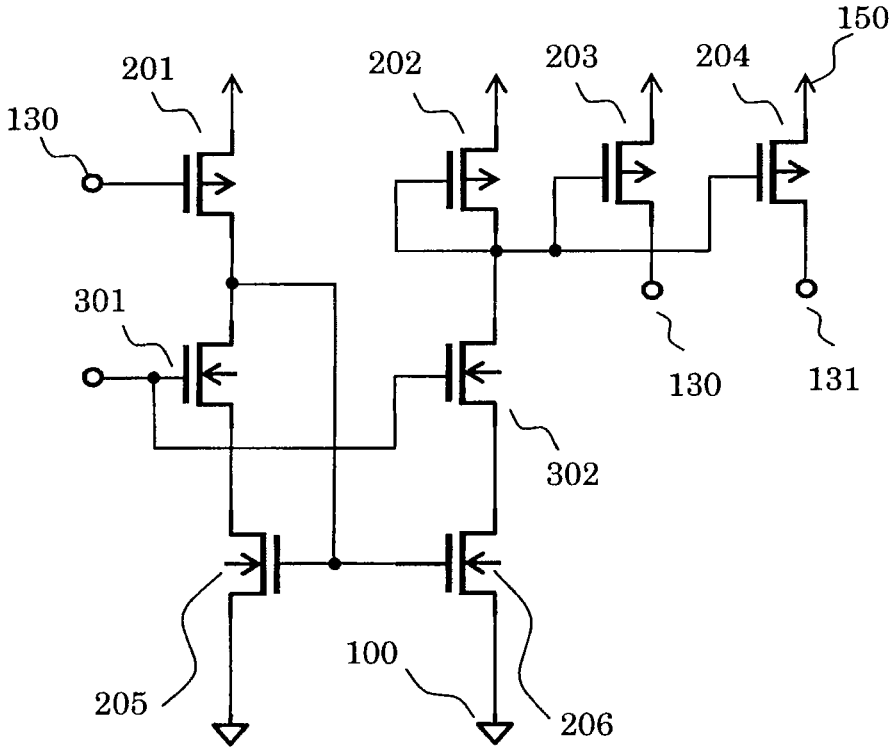
FIG. 3 is a circuit diagram illustrating a second embodiment of the current mirror circuit.

FIG. 3 is a circuit diagram illustrating a second embodiment of a current mirror circuit 110 related to the voltage regulator in accordance with the present invention. The current mirror circuit of the second embodiment has additional NMOS transistors 301 and 302 to enable the current mirror circuit to be driven at a low voltage and to provide an accurate current mirror. The NMOS transistor 301 is added between a PMOS transistor 201 and an NMOS transistor 205, the gate of the NMOS transistor 205 being connected to the drain of the NMOS transistor 301. The NMOS transistor 302 is added between a PMOS transistor 202 and an NMOS transistor 206, the gate of the NMOS transistor 206 being connected to the drain of the NMOS transistor 301. The gate voltages for the NMOS transistors 301 and 302 are supplied from another circuit.

In the current mirror circuit of the second embodiment, the NMOS transistors 301 and 302 act as a cascode circuit to improve the accuracy of the current mirror circuit of the NMOS transistors 205 and 206. Further, the gate voltages for the NMOS transistors 301 and 302 are supplied from another circuit, thereby making it possible to control the upper limit of the consumption current of the cascode type current mirror circuit formed by the NMOS transistors 205, 206, 301 and 302 to a low level.

As described above, the voltage regulator in accordance with the present invention, which has the phase compensation circuit with the current mirror circuit of the second embodiment, is capable of preventing the occurrence of an offset in the transistor of the input stage of the differential amplifier circuit 102 so as to prevent fluctuations in the output voltage attributable to the offset, thus permitting accurate setting of an output voltage. In addition, the consumption current of the phase compensation circuit 160 can be controlled to a low level according to the magnitude of the current passed from the PMOS transistor 106 to the load resistance $R_{out}$, making it possible to limit the drive current of the phase compensation circuit 160 so as to prevent the drive current from becoming excessive in the case where the value of the current passed from the PMOS transistor 106 to the load resistance is large.

Fourth Embodiment

Figure 4:
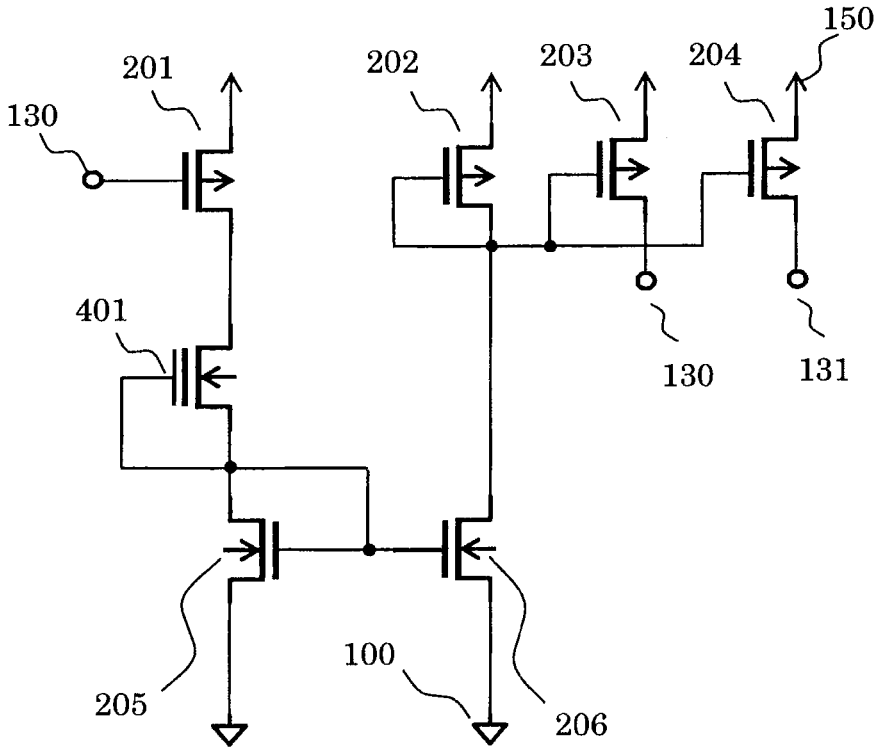
FIG. 4 is a circuit diagram illustrating a third embodiment of the current mirror circuit.

FIG. 4 is a circuit diagram illustrating a third embodiment of a current mirror circuit 110 related to the voltage regulator in accordance with the present invention. In the current mirror circuit of the third embodiment, an NMOS transistor 401 has been added as a current source between the PMOS transistor 201 and the NMOS transistor 205. The NMOS transistor 401 is a depletion-type transistor, the gate thereof being connected to the drain of the NMOS transistor 205.

A depletion-type transistor having a fixed voltage between the gate and the source acts as a constant-current source when the operation state thereof reaches a saturation range. When the value of the load current from the PMOS transistor 106 referred to by the PMOS transistor 201 exceeds a predetermined value, the NMOS transistor 401 acts as the constant-current source, thereby restricting the drive current of the phase compensation circuit 160.

As described above, the voltage regulator in accordance with the present invention, which has the phase compensation circuit with the current mirror circuit of the third embodiment, is capable of preventing the occurrence of an offset in the transistor of the input stage of the differential amplifier circuit 102 so as to prevent fluctuations in the output voltage attributable to the offset, thus permitting accurate setting of an output voltage. In addition, the consumption current of the phase compensation circuit 160 can be controlled to a low level according to the magnitude of the current passed from the PMOS transistor 106 to the load resistance $R_{out}$, making it possible to limit the drive current of the phase compensation circuit 160 so as to prevent the drive current from becoming excessive in the case where the value of the current passed from the PMOS transistor 106 to the load resistance is large.

Fifth Embodiment

Figure 5:
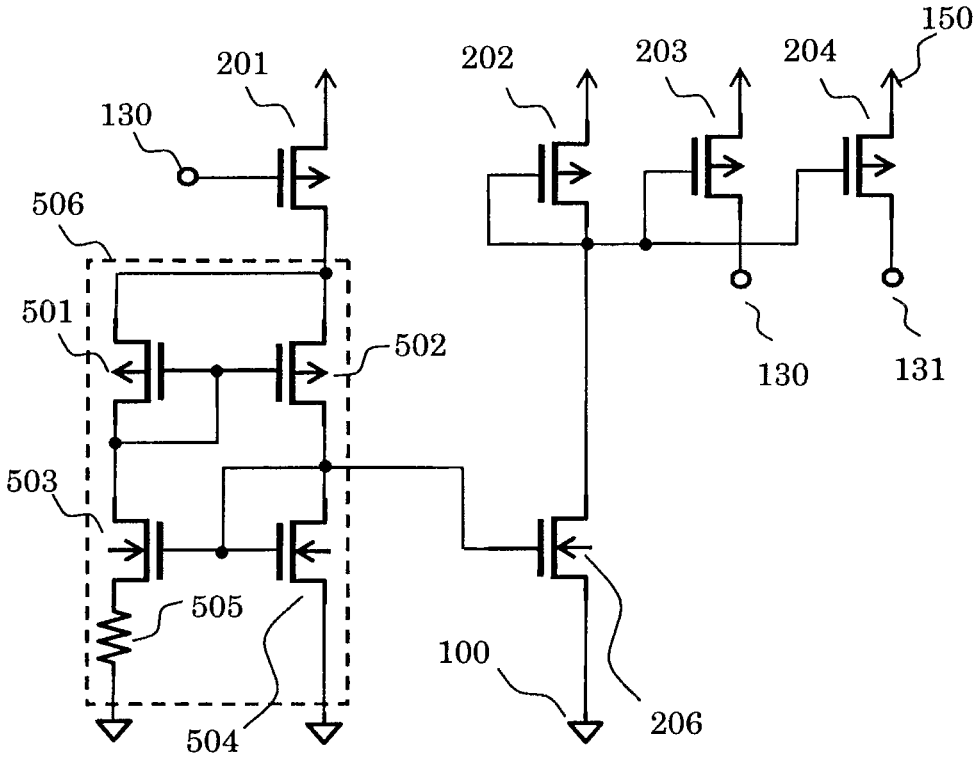
FIG. 5 is a circuit diagram illustrating a fourth embodiment of the current mirror circuit.
Figure 6:
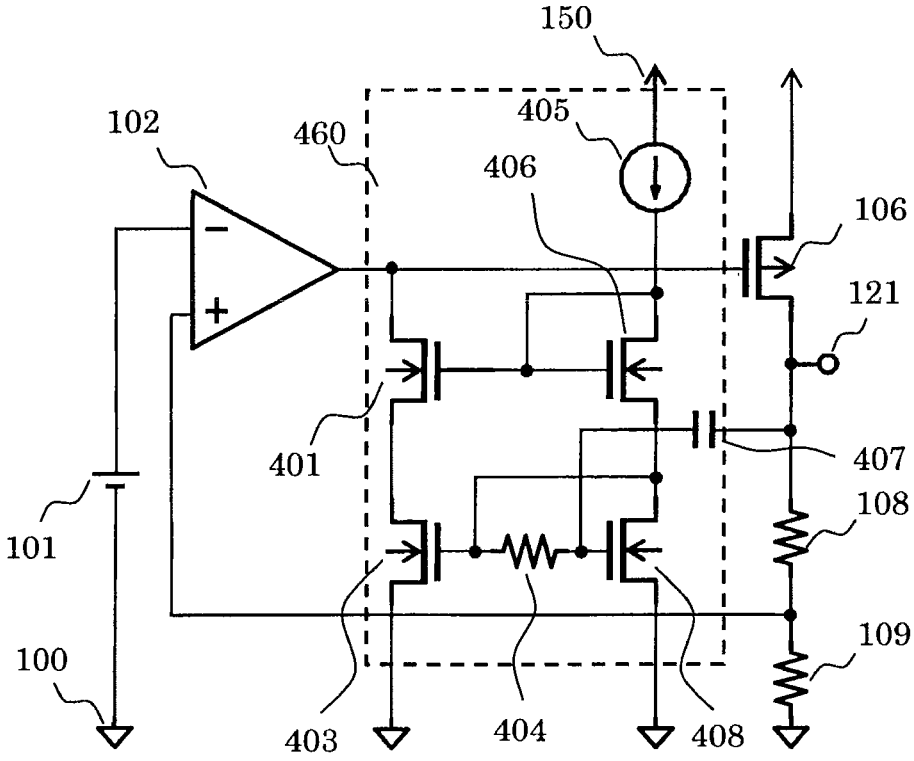
FIG. 6 PRIOR ART
FIG. 6 is a circuit diagram illustrating a conventional voltage regulator.
Figure 7:
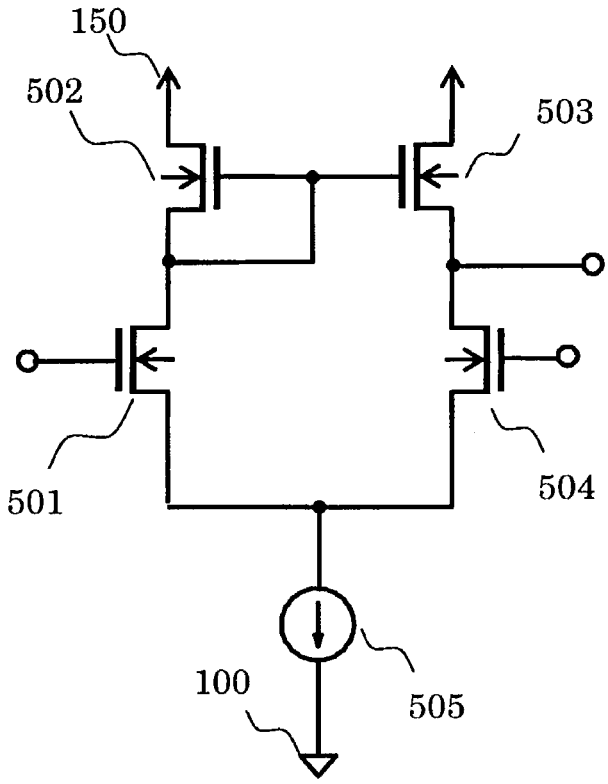
FIG. 7 PRIOR ART
FIG. 7 is a circuit diagram illustrating a differential amplifier circuit constituted of a one-stage amplifier.

FIG. 5 is a circuit diagram illustrating a fourth embodiment of a current mirror circuit 110 related to the voltage regulator in accordance with the present invention. In the current mirror circuit of the fourth embodiment, a constant-current source circuit 506 has been added to replace the NMOS transistor 205. The constant-current source circuit 506 is constituted of PMOS transistors 501 and 502, NMOS transistors 503 and 504, and a resistor 505.

The source of the PMOS transistor 501 is connected to the drain of a PMOS transistor 201, the gate thereof is connected to the drain of the PMOS transistor 501, and the drain thereof is connected to the drain of the NMOS transistor 503. The source of the PMOS transistor 502 is connected to the drain of the PMOS transistor 201, the gate thereof is connected to the drain of the PMOS transistor 501, and the drain thereof is connected to the drain of the NMOS transistor 504. The gate of the NMOS transistor 503 is connected to the drain of the NMOS transistor 504, and the source thereof is connected to the resistor 505. The gate of the NMOS transistor 504 is connected to the drain of the NMOS transistor 504, and the source thereof is connected to a ground terminal 100. The other end of the resistor 505 is connected to the ground terminal 100.

The PMOS transistors 501 and 502 constitute a current mirror circuit. The NMOS transistors 503 and 504 constitute a current mirror circuit having the gates thereof interconnected, while the source of the NMOS transistor 503 is connected to the ground terminal 100 through a resistor. Hence, a voltage drop takes place in the resistor 505 due to the drain current of the NMOS transistor 503, causing the gate-source voltage of the NMOS transistor 503 to decrease accordingly. The voltage drop in the resistor 505 is determined by the difference in value K between the NMOS transistors 503 and 504 or the difference in value K between the PMOS transistors 501 and 502 and the value of the resistor 505, thus providing a constant-current source circuit that does not depend upon a supply voltage.

When the value of the load current from the PMOS transistor 106 referred to by the PMOS transistor 201 exceeds a predetermined value, the constant-current source circuit 506 acts as the constant-current circuit, thereby restricting the value of the drive current of the phase compensation circuit 160.

As described above, the voltage regulator in accordance with the present invention, which has the phase compensation circuit with the current mirror circuit of the fourth embodiment, is capable of preventing the occurrence of an offset in the transistor of the input stage of the differential amplifier circuit 102 so as to prevent fluctuations in the output voltage attributable to the offset, thus permitting accurate setting of an output voltage. In addition, the consumption current of the phase compensation circuit 160 is controlled to a low level according to the magnitude of the current passed from the PMOS transistor 106 to the load resistance $R_{out}$, making it possible to limit the drive current of the phase compensation circuit 160 so as to prevent the drive current from becoming excessive in the case where the value of the current passed from the PMOS transistor 106 to the load resistance is large.

What is claimed is:

1. A voltage regulator comprising:

an error amplifier circuit which amplifies and outputs the difference between a reference voltage and a divided voltage obtained by dividing a voltage output by an output transistor so as to control a gate of the output transistor; and a phase compensation circuit, wherein the phase compensation circuit comprises:

a first transistor having a drain thereof connected to an output terminal of the error amplifier circuit;

a second transistor having a drain thereof connected to a gate of the first transistor and a gate thereof connected to the gate of the first transistor through a resistor;

a current mirror circuit which comprises a voltage detector transistor detecting a voltage input to the gate of the output transistor, mirrors current flowing into the voltage detector transistor and supplies current to a drain of the first transistor and a drain of the second transistor; and a first capacitor connected between a gate of the second transistor and a drain of the output transistor.

2. The voltage regulator according to claim 1, wherein the current mirror circuit has an upper limit of current flowing into the voltage detector transistor set to a predetermined value.

3. The voltage regulator according to claim 2, wherein the current mirror circuit is a cascode current mirror circuit, and the cascode current mirror circuit has at least one stage of a current mirror circuit section having a gate connected to an external circuit.

4. The voltage regulator according to claim 2, wherein a depletion-type transistor, which has a gate thereof connected to a source thereof, is connected to a drain of the voltage detector transistor.

5. The voltage regulator according to claim 2, comprising:

a third transistor having a source thereof connected to the drain of the voltage detector transistor and a gate thereof connected to a source thereof;

a fourth transistor having a source thereof connected to the drain of the voltage detector transistor and a gate thereof connected to the gate of the third transistor;

a fifth transistor having a drain thereof connected to a drain of the fourth transistor, a gate thereof connected to a drain thereof, and a source thereof grounded;

a sixth transistor having a drain thereof connected to the drain of the third transistor, and a gate thereof connected to the gate of the fifth transistor; and a first resistor having the other end thereof, which is connected to a source of the sixth transistor, grounded.

* * * * *